US005415319A

United States Patent [19]

Risolia

[11] Patent Number: 5,415,319

[45] Date of Patent: May 16, 1995

[54] VENDING MACHINE

[76] Inventor: Joe Risolia, 1934 NE. 147 Ter., N. Miami, Fla. 33181

[21] Appl. No.: 206,433

[22] Filed: Mar. 7, 1994

[51] Int. Cl.[6] ..... G07F 11/00

[52] U.S. Cl. ..... 221/3; 221/13

[58] Field of Search ..... 221/2, 3, 7, 9, 13

[56] References Cited

U.S. PATENT DOCUMENTS 4,954,697 9/1990 Kokubun et al. ..... 221/3

FOREIGN PATENT DOCUMENTS 8907807 8/1989 European Pat. Off. ..... 221/3

*Primary Examiner*—Kenneth W. Noland

*Attorney, Agent, or Firm*—Robert M. Downey

[57] ABSTRACT

A machine for vending articles of merchandise such as compact discs, cassette tapes, video tapes, books and the like, the machine including an enclosed cabinet with a front door having a window to permit viewing of an interior thereof. The interior of the cabinet is provided with racks for supporting and organizing the articles of merchandise in rows with a front article in each row arranged in a preferred viewing orientation relative to the window. A compact disc player and disc exchanger is further supported within the interior of the cabinet and interconnected with controls and headphones on the front door, the compact disc player being adapted to play various selected recordings on at least one disc contained therein, the selected recordings corresponding with the articles of merchandise supported on the racks. Controls on the front door being further structured to release a selected one of the articles of merchandise, upon depositing a predetermined amount of money in the machine, whereupon the article is dropped into a catch bin for retrieval by the consumer.

12 Claims, 3 Drawing Sheets

VENDING MACHINE

BACKGROUND OF THE INVENTION

1. Field of the Invention

The present invention relates to vending machines, and specifically to vending machines having audio means for playing a sound recording, including music or voice, the sound recording corresponding with articles of merchandise contained in the machine for vending.

2. Description of the Related Art

Machines for vending various articles of merchandise are well known in the art. Specifically, there are numerous types of vending machines for vending canned or bottled beverages such as soft drinks. Additionally, there are numerous types of vending machines which are structured to contain a vast array of snack foods, candy, cigarettes and like items, wherein the various articles of merchandise are supported in an organized arrangement and visible to the consumer through a window. Each of the various articles of merchandise are generally contained in a row having a code, such as a letter and two digit number corresponding with that row. A control panel is provided having individual buttons for letters and digits, whereupon depressing the appropriate buttons corresponding with the desired code, the select article to be purchased is released and dropped into a retrieval area.

In most instances, the consumer is apparently familiar with the food merchandise being sold in the vending machine. For instance, there are many soft drink products which most of the consuming public has tasted at one time or another, and therefore, the consumer usually knows in advance whether he or she likes that particular product.

There are, however, other less familiar articles of merchandise which could be sold through vending machines if the consumer was given an opportunity to learn more about the product. Specifically, many consumers are not entirely familiar with articles of merchandise which are essentially one time purchase goods, such as musical recordings on compact discs and cassette tapes, video tapes, books and other like articles. Because most consumers have not heard an entire music album or read a book prior to purchasing, they may be somewhat skeptical about purchasing the particular article of merchandise only to find out later that they do not like the music, story, etc. For this reason, it is believed that merchandise such as compact discs, cassette tapes, books, video tapes and other like goods would not sell as successfully through vending machines as do more popular and well known commodities such as soft drinks and snack foods unless the consumer is provided with a means to learn more about the merchandise prior to purchasing.

Accordingly, there is a need in the vending machine art for an assembly for vending merchandise such as compact discs, cassette tapes, books and video tapes, wherein the assembly is specifically structured to permit the consumer to first learn more about the product and become familiarized with it prior to purchasing.

SUMMARY OF THE INVENTION

The present invention is directed to a machine for vending individual articles of merchandise such as, but not limited to, compact discs, cassette tapes, video tapes and books. In accordance with the present invention, there is provided a cabinet comprising a base, vertical walls, a top and a front door hingedly attached to the walls, base and/or the top of the cabinet so as to be movable to facilitate access to an enclosed interior thereof. The front door includes a window specifically sized and arranged on the door to facilitate viewing of articles of merchandise arranged within the interior of the cabinet.

Rack means are provided within the interior for supporting the articles of merchandise in an ordered arrangement in accordance with a preferred viewing orientation relative to the window. Specifically, the rack means is structured for organizing the articles in rows at various levels such that a first article of merchandise in each row is readily visible to a consumer through the window of the door. Each of the rows is identified by a code and is provided with release means for releasing the forward-most article (relative to the window) upon depositing a predetermined amount of money through a coin or bill collector and depressing appropriate buttons of a control panel on the front door. In a preferred embodiment, the release means comprises a rigid spiral wire or coil extending from a rear of the interior towards the window in each of the rows throughout the rack means. Articles of merchandise are supported between adjacent loops of the coil in the same manner as conventional snack vending machines of the type including a spiral wire for release means. After having deposited the appropriate amount of money, upon depressing a code on the buttons of the control panel corresponding with the code of the row containing the desired articles of merchandise, the particular coil in that row is caused to rotate one complete turn, resulting in each of the articles in that row advancing forwardly towards the window with the forward-most article being released into a catch bin attached to an inside of the door. An access opening is provided in direct communication with the catch bin to facilitate retrieval of the released article of merchandise therefrom once purchased.

In order to provide a means for the consumer to familiarize himself/herself with the various articles of merchandise being sold, an audio means is provided including a compact disc player and disc exchanger located within the cabinet interior and interconnected with the control means on the front door. The CD player is specifically structured to receive commands from the control means, and thereafter play a sound recording corresponding with the command. The commands entered on the control panel correspond with the location of the various articles of merchandise displayed. In this manner, a consumer is provided with information or an audible sample relating to the desired article to be purchased by simply entering the appropriate code on the control panel, prior to depositing money, whereupon a sound recording is played for the consumer. Headphones are provided to facilitate private listening of the sound recording without distracting other people near the machine.

Accordingly, it can be realized that, for instance, in the sale of compact discs containing musical recordings of various recording artists, the consumer would have the opportunity to first listen to the compact disc prior to depositing money and purchasing a disc. In this example, each of the rows would be filled with compact discs (or cassette tapes) of a particular recording artist or group. The consumer being able to see the covers of the various compact discs arranged in the rack means, is able to listen to any of the recordings on those compact discs by entering the code corresponding with the position of the desired compact disc. Upon entering the code, the compact disc player and disc exchanger is commanded to play the particular selected compact disc. Controls for fast forward, reverse, stop as well as volume control may further be provided on the control panel.

In the instance of videos or books, a sound recording summarizing the plot or material in the book or on the video could be provided to the user. Additionally, comments from various well-known critics may be provided on a sound recording for the consumer to listen to prior to deciding to purchase the video or book.

Accordingly, with the foregoing in mind, it is a primary object of the present invention to provide an assembly for vending individual articles of merchandise and including audio means to provide the consumer with information and/or an audible sampling of recorded material contained on the articles of merchandise prior to purchasing.

It is a further object of the present invention to provide an assembly for vending individual articles of merchandise and specifically compact discs and cassette tapes wherein a consumer is able to listen to the music or other sound recording contained on the compact discs or cassette tapes prior to making a decision to purchase a particular compact disc or cassette tape.

It is still a further object of the present invention to provide an assembly for vending individual articles of merchandise and particularly books, such as best selling novels, wherein the consumer is provided with an audio recording providing information about the books being vended including a summary of the material contained therein as well as possibly critics reviews.

It is still another object of the present invention to provide an assembly for vending individual articles of merchandise, and particularly video cassettes, wherein the consumer is able to listen to a sound recording providing information about each of the video cassettes being vended including a summary of the material contained on the video cassette as well as critics reviews.

These and other objects and advantages of the present invention will be more readily apparent in the description which follows.

BRIEF DESCRIPTION OF THE DRAWINGS

For a fuller understanding of the nature of the present invention reference should be had to the following detailed description taken in connection with the accompanying drawings in which.

DETAILED DESCRIPTION OF THE PREFERRED EMBODIMENT

Figure 1:
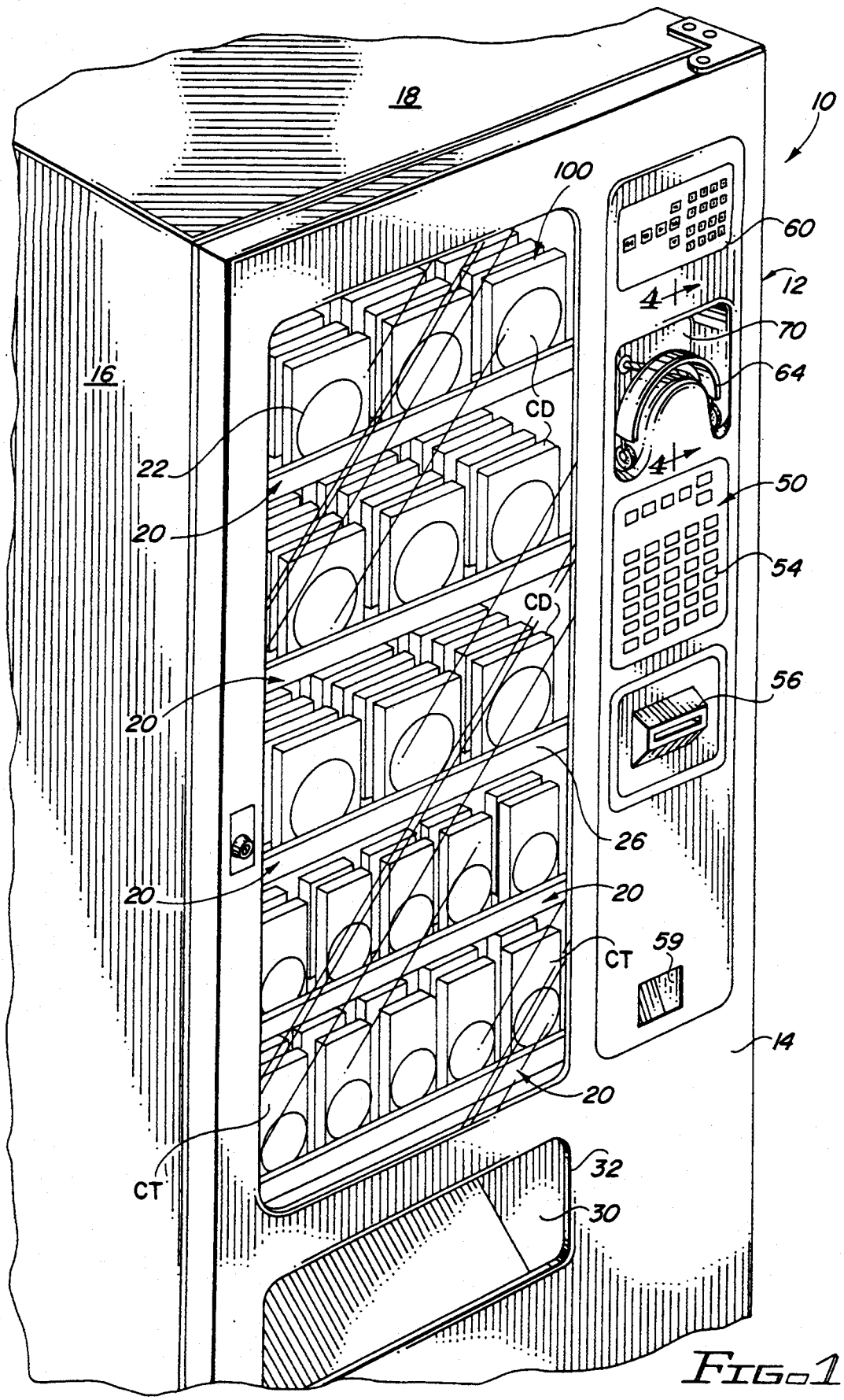
FIG. 1 is a front perspective view of the cabinet of the vending assembly of the present invention.
Figure 2:
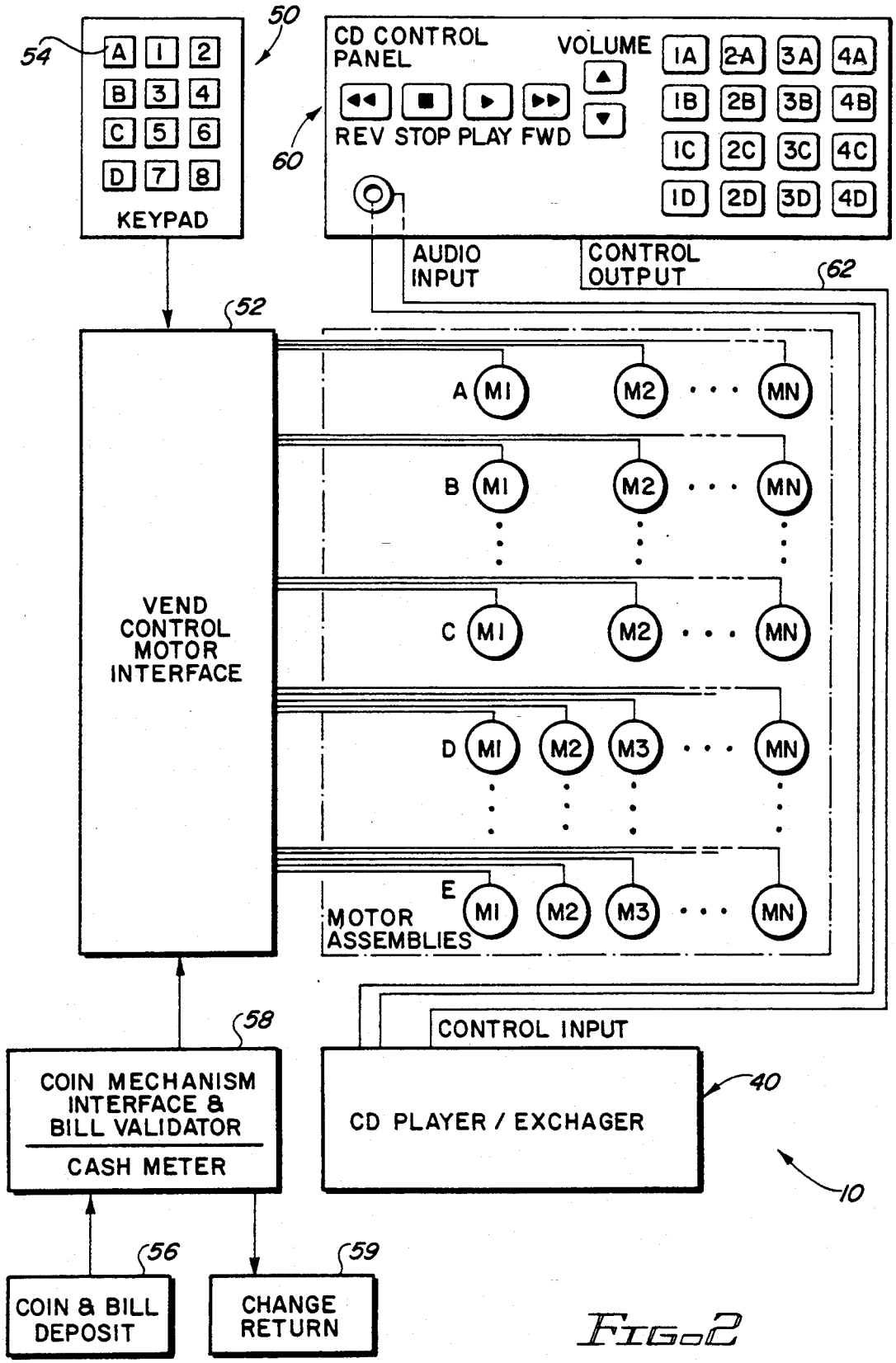
FIG. 2 is a schematic diagram illustrating the structural relation and operation of various components of the assembly of the present invention.

Referring to the several views of the drawings, and initially FIGS. 1 and 2, there is generally illustrated the vending assembly 10 of the present invention. As seen in FIG. 1, the assembly 10 includes a cabinet 12 having at least a front door 14 or front panel. The cabinet 12 may further be provided with side walls such as 16, a top 18 and a base and back wall which are not shown for purposes of clarity and to avoid confusion. The cabinet 12 is specifically structured to contain individual articles of merchandise 100 including such articles as compact discs CD and cassette tapes CT. The articles of merchandise 100 are supported on racks 20 having a plurality of spiral wires or coils 22 identical to those commonly used in many snack vending machines. The coils 22 extend from a forward portion of the cabinet towards a rear of the cabinet and are specifically structured to organize and arrange the individual articles 100 in rows throughout the various levels of the racks 20 such that a forward-most one of the articles 100 in each row is readily visible through a window 26 of the front door 14.

Each of the coils is attached at one end, towards a rear of the cabinet to an individual motor assembly as identified in FIG. 2. Each of the motor assemblies AMI-EMN is specifically structured to rotate the corresponding attached coil a complete turn upon actuation thereof. Rotation of the coil results in forward progression of each of the individual articles supported between loops of the coil in that row. As a result of the forward progression of the individual articles, the forward most article of merchandise in that particular row is caused to be dropped from the rack 20 and into a catch bin 30. An access opening 32 is provided on the front door 14 to facilitate retrieval of the article deposited in the catch bin 30. A movable flap may be provided in covering relation to the access opening 32 (not shown in the drawings) to prevent articles of merchandise dropped in the catch bin from bouncing out through the access opening 32. In order to prevent damage to such articles as compact discs and cassette tapes, the catch bin is lined with a layer of padding 34 on all surfaces thereof. In this manner, the shock of impact from a article of merchandise falling from a top one of the racks is substantially absorbed, thus preventing damage to the merchandise.

Referring to FIG. 2, the assembly is further provided with a compact disc player and disc exchanger 40 which is housed within the cabinet 12 behind the front door 14 and preferably near a base or floor of the cabinet 12. The compact disc player and disc exchanger 40 is specifically structured to accommodate at least one, and preferably a number of compact discs having various sound recordings thereon. In the instance of the sale of compact discs in the vending assembly 10 of the present invention, at least one or more, and preferably all of the compact discs supported on the racks is contained within the compact disc player and disc exchanger. For instance, if there were a total of nine different albums on compact discs for various recording artists or groups, then each of the nine discs would be contained within the CD player/exchanger 40. Upon a command entered by the user, the CD player/exchanger 40 is commanded to play the selected disc for the user to listen to.

Control means are further provided to facilitate individual and selective control of each of the motor assemblies to cause a select one of the articles of merchandise 100 to be dropped into the catch bin 30 when purchasing. The control means is further structured to actuate and control the CD player/exchanger 40 so that a select sound recording is caused to be played, the sound recording corresponding with at least one of the articles of merchandise 100 supported on the racks 20 for purchase. In a first embodiment, as seen in FIG. 2, the control means includes separate control panels including a key pad control panel 50 for controlling actuation of the motor assemblies AMI-EMN and a CD control panel 60 for controlling operation of the CD player/exchanger 40. In the embodiment of FIG. 2, the key pad 50 is interconnected with a vend control motor interface 52. Upon depressing a predetermined combination represented by indicia on buttons 54 of the key pad, the vend control motor interface 52 determines which of the motor assemblies, AMI-EMN, to actuate. Prior to actuation of the motor assemblies however, a predetermined amount of money must be deposited through a coin and/or bill deposit 56 on the front door 14. Once an amount of money has been deposited in the coin and bill deposit 56, a coin mechanism interface and bill validator 58 identify the type of currency deposited and a cash meter calculates the amount. Upon reaching a predetermined amount, the coin mechanism and bill validator 58 enable the vend control motor interface 52 to actuate a selected one of the motor assemblies. Any amount of money inserted beyond the predetermined amount is determined by the cash meter and appropriate change is released through the change return 59.

The CD control panel 60 and control unit 61 is independently interconnected with the CD player/exchanger 40 in the embodiment of FIG. 2. Specifically, a first cable 62 connects between a control output from the control panel 60 to a control input of the CD player-/exchanger 40. A plurality of control buttons are provided on the CD control panel 60 including a set of CD selection buttons organized in a group and labeled 1A–4D. The labels for the CD control buttons correspond with a particular code for each row of the articles of merchandise on the racks 20. In this manner, by depressing one of the CD control buttons, the CD player/exchanger 40 is commanded to play a sound recording corresponding with the article of merchandise contained in the row identified on the particular CD control button depressed on the CD control panel 60. The CD control panel 60 is further provided with CD player controls including controls to play, stop, fast forward and reverse the sound recording being played. The player controls further include volume control buttons to increase or decrease the volume as provided through the audio output of the CD player to audible means such as a speaker or headphones 64 connected to an audio input on the CD control panel. Alternatively, the headphones set 64 may be connected through to the control unit 61 behind the CD control panel with the external portion of the wire extending from the headphone encapsulated within a metal sleeve 66 to prevent vandalism. A flanged cap 68 attached at one end of the metal sleeve 66 prevents the sleeve and headphone wires from being pulled from the front wall 14 of the cabinet 12. In order to facilitate hanging support of the headphones 64 during nonuse, a recessed headphone support 70 may be provided through the front wall 14. Alternatively, a peg or hook may be provided on the front wall 14 to facilitate hanging of the headphone set 64 thereon.

Figure 3:
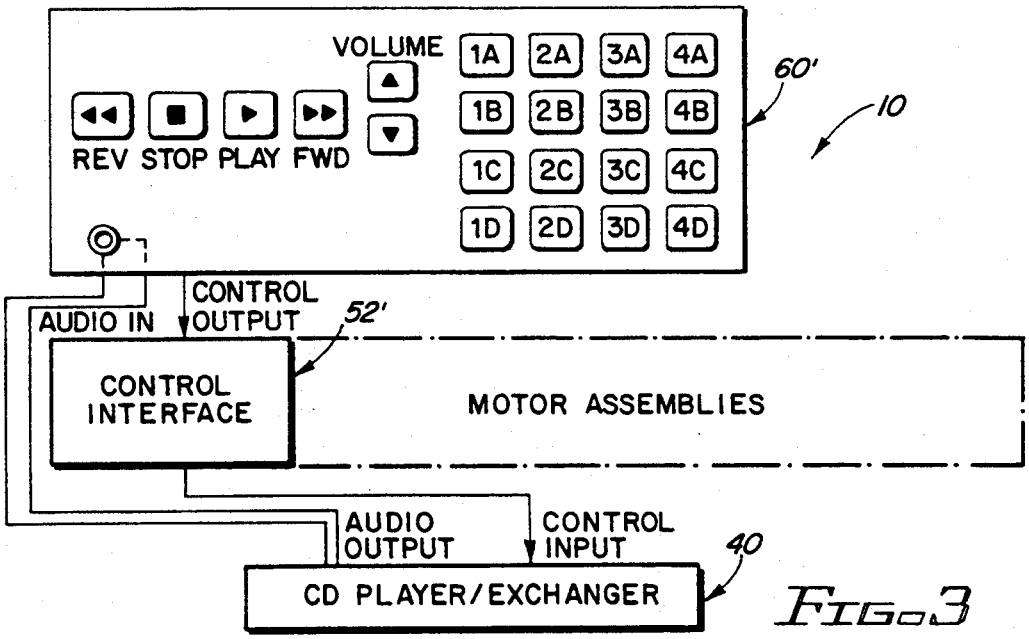
FIG. 3 is a schematic diagram illustrating an alternative embodiment of a control assembly of the present invention.
Figure 4:
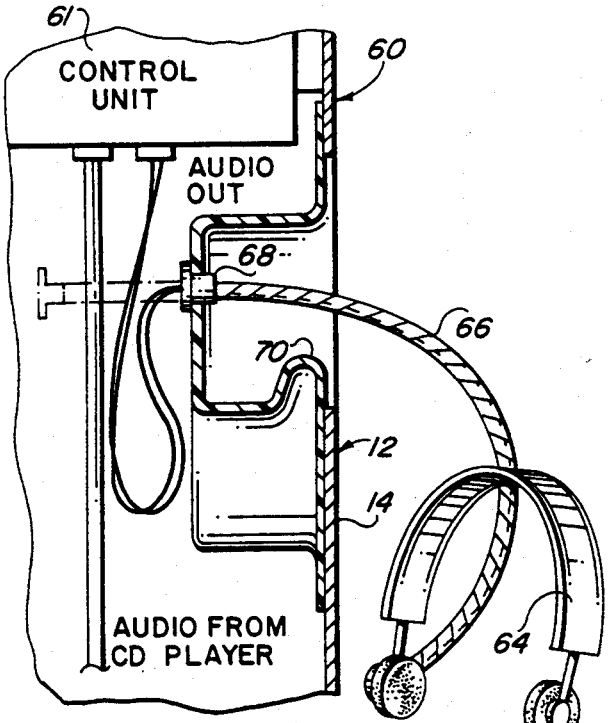
FIG. 4 is an isolated view, shown in partial section, taken along the line 4—4 of FIG. 1.
Figure 5:
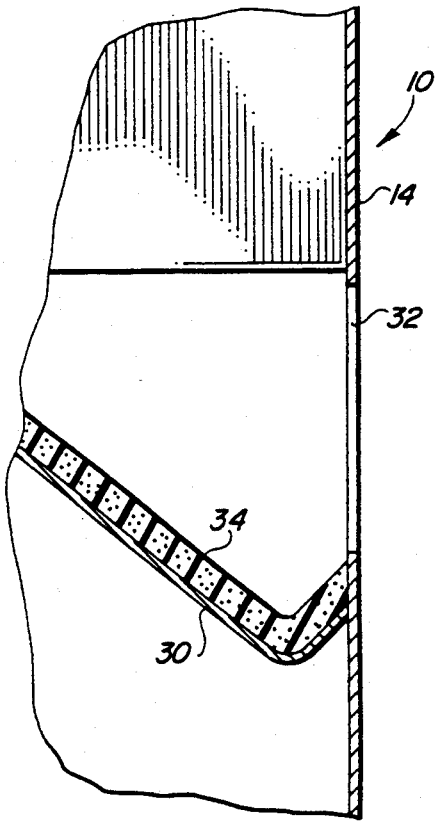
FIG. 5 is an isolated sectional view of a catch bin and access opening on the front door of the cabinet.

Referring to FIG. 3, there is illustrated an alternative embodiment of the control means of the present invention, wherein a single control panel is used to control both actuation of the motor assemblies and the CD player/exchanger 40. In this particular embodiment, the control panel 60' would be substantially identical to the CD control panel 60 of FIG. 2. The control unit 61 behind the control panel 60' would be connected directly to control interface 52' so that all control commands for both the motor assemblies and the CD player/exchanger are processed through the control interface 52'. In this particular embodiment, if the consumer has not yet deposited any predetermined amount of money through the coin and bill deposit 56, then any entries made on the key pad having buttons labeled 1A–4D would cause the control interface 52' to command the CD player/exchanger. Similarly, any entries made on the CD player control buttons for play, stop, fast forward, rewind and volume would be processed through the control interface 52' to the CD player/exchanger 40. Once having deposited the predetermined amount of money through the coin and bill deposit 56, the coin mechanism and bill validator 58 would cause the control interface 52' to enable actuation of the motor assemblies. In this instance, an entry made on the control panel on the buttons labeled 1A–4D would cause one of the selected motor assemblies to be actuated. Prior to depositing the predetermined amount of money, depressing the buttons labeled 1A–4D would cause the CD player/exchanger 40 to play the sound recording corresponding with the particular button depressed.

While this invention has been shown and described in a preferred embodiment, it is recognized that departures may be made within the spirit and scope of the invention which should not therefore be limited except by the following claims and within the Doctrine of Equivalents.

Now that the invention has been described,

What is claimed is:

1. An assembly for vending individual articles of merchandise comprising;

a cabinet including a base, a plurality of vertical walls, a door and a top disposed in surrounding relation to an enclosed cabinet interior, said door including a window and an access opening therethrough, rack means for supporting the articles of merchandise in an ordered arrangement within said cabinet interior in a preferred viewing orientation relative to said window, a catch bin on an inner side door below said rack means and communicating with said access opening, release means for releasing a select one of said articles of merchandise from said rack means so as to cause said article to fall into said catch bin, facilitating retrieval of said article through said access opening from an exterior of said cabinet, a compact disc player and disc exchanger structured and disposed to contain and selectively play a plurality of compact discs, audible means for facilitating listening of a sound recording on said compact discs played by said compact disc player, said sound recording corresponding with at least one of said articles of merchandise supported on said rack means, control means exteriorly accessible on said door and interconnected to and structured for controlling said compact disc player and disc exchanger and said release means, said control means including means for selecting one of said compact discs to be played and further including means for selecting one of said articles of merchandise to be released from said rack means by said release means, and interface means interconnected between said control means and said release means, said interface means being further interconnected with a money deposit mechanism and being specifically structured to prevent actuation of said release means until a deposit of a predetermined amount of money is received through said money mechanism.

2. An assembly as recited in claim 1 wherein said rack means further includes means for arranging said individual articles of merchandise in rows extending from a rear of the cabinet interior to a forward portion of the cabinet interior.

3. An assembly as recited in claim 2 wherein said rows are disposed on a plurality of levels within the cabinet interior so that a forward-most one of said articles of merchandise in each of said rows is positioned and arranged in a preferred viewing orientation relative to said window of said door.

4. An assembly for vending individual articles of merchandise comprising:

a cabinet including at least a front panel, rack means disposed behind said front panel and specifically structured for supporting the articles of merchandise in an ordered arrangement within said cabinet interior in accordance with a predetermined order, release means for releasing a select one of said articles of merchandise from said rack means, retrieval means on said front panel to facilitate retrieval of said select one of said articles of merchandise released from said release means, audio means for playing selected ones of a plurality of sound recordings, each of said sound recordings corresponding with at least one of said individual articles of merchandise, control means exteriorly accessible on said front panel and interconnected to and structured for controlling said audio means and said release means, said control means including selection means for selecting one of said sound recordings to be played and for further selecting one of said articles of merchandise to be released from said rack means by said release means, a money deposit mechanism and control interface interconnecting between said control means and said release means for preventing actuation of said release means by said control means until a predetermined amount of money has been deposited through said money deposit mechanism, said control means further including at least one control panel on said front panel, said control panel including a plurality of input buttons for selectively controlling said audio means and said release means, and said audio means including a compact disc player and disc exchanger structured and disposed to contain and selectively play at least one compact disc.

5. An assembly as recited in claim 4 wherein said audio means includes a compact disc player and disc exchanger structured and disposed to contain and selectively play at least one compact disc.

6. An assembly as recited in claim 5 further including audible means for facilitating listening of said sound recording on said compact disc being played by said compact disc player.

7. An assembly as recited in claim 6 wherein said audible means includes at least one headphone set interconnected to an audio output of said compact disc player and disc exchanger facilitating listening to the sound recording.

8. An assembly for vending products comprising:

a cabinet including at least a front panel, first product storage means for storing a first set of products to be purchased, said first set of products being stored in a predetermined ordered arrangement, second product storage means for storing a second set of products in a predetermined ordered arrangement, said second set of products being identical to at least some products of said first set of products, release means for releasing a select one of the products from said first product storage means, retrieval means on said front panel to facilitate retrieval of said select one of said products released by said release means, sampling means for selectively providing a sample of the products of said second set of products stored in said second product storage means, and control means exteriorly accessible on said front panel and interconnected to and structured for controlling said sampling means and said release means, said control means including selection means for selecting one of said products of said second set to be sampled and for further selecting one of said products of said first set to be released from said first product storage means by said release means.

9. An assembly as recited in claim 8 wherein said products include sound recordings.

10. An assembly as recited in claim 9 wherein said sampling means includes audio means for playing selected ones of said sound recordings stored in said second product storage means.

11. An assembly as recited in claim 10 wherein said sound recordings include compact discs.

12. An assembly as recited in claim 11 wherein said audio means includes a compact disc player and disc exchanger structured and disposed to contain and selectively play at least one compact disc.

* * * * *